United States Patent [19]

Seabrooke

[11] 4,426,743

[45] Jan. 24, 1984

[54] TOILET SEAT LIFTING DEVICE

[75] Inventor: Allan B. Seabrooke, Bradenton, Fla.

[73] Assignee: Sani-Seat, Incorporated, Bradenton, Fla.

[21] Appl. No.: 410,996

[22] Filed: Aug. 24, 1982

[51] Int. Cl.[3] ..... A47K 13/10

[52] U.S. Cl. ..... 4/251; 4/661

[58] Field of Search ..... 4/251, 661

[56] References Cited

U.S. PATENT DOCUMENTS

| | | | |
|---|---|---|---|
| 1,308,596 | 7/1919 | Klein | 4/251 |
| 1,792,811 | 2/1931 | Bustin | 4/251 |
| 1,863,682 | 6/1932 | Alberts | 4/251 |
| 2,814,049 | 11/1957 | Mercur | 4/251 |

FOREIGN PATENT DOCUMENTS

| | | | |
|---|---|---|---|
| 612930 | 11/1926 | France | 4/251 |
| 531962 | 8/1955 | Italy | 4/251 |

*Primary Examiner*—Henry K. Artis

*Attorney, Agent, or Firm*—Cushman, Darby & Cushman

[57] ABSTRACT

An operator-controlled, toilet-seat lifting device applies a constant bias force, for example, by means of a helical spring, to the seat in a direction tending to raise the seat. The weight of the seat is sufficient to overcome the constant bias force so that the seat normally assumes a horizontal or down position. To raise the seat the user increases the bias force, for example, by depressing a foot-operated pedal connected to the bias means, so as to overcome the weight of the seat and cause the seat to swing upwardly. As the seat is held in raised position solely by bias force, forcible manual lowering of the seat when in its raised position does not damage any of the components.

9 Claims, 8 Drawing Figures

TOILET SEAT LIFTING DEVICE

This invention relates to a toilet seat control mechanism for raising and lowering a toilet seat without requiring touching of the seat.

BACKGROUND

Toilet seat lifters which eliminate the need to touch the toilet seat, particularly foot-controlled lifters, are disclosed in a number of prior patents and publications. The following prior art, relating to such devices or to spring-biased toilet seats generally, is known to the applicant.

U.S. Pat. No. 4,150,446 to Crocker discloses a pedal-operated pull cable arrangement to raise a toilet seat to an open position.

Norwegian Pat. No. 16,354, cited in the Crocker patent, discloses a lid operating mechanism somewhat similar to the Crocker mechanism.

U.S. Pat. No. 2,814,049 to Mercur discloses a spring loaded toilet seat wherein the spring arrangement biases the seat toward a vertical position and includes a second spring 39 which prevents the seat from violently hitting against the tank of the toilet.

U.S. Pat. No. 1,999,971 to Williamson discloses a foot-operated toilet seat having a helical spring 18 which urges the toilet seat shaft downwardly.

U.S. Pat. No. 428,001 discloses a toilet lid having a hinge which is spring-biased toward a closed position.

SUMMARY OF THE INVENTION

The principal object of the invention is to provide an operator-controlled, toilet-seat lifting device which is not likely to be damaged by manually forcing the seat downwardly at a time when the seat is being held in an up position by the lifting device. This is accomplished, broadly, by providing a bias assembly which applies a biased, resilient lifting force to the seat sufficient to raise the seat when the lifting device is actuated and which will resiliently absorb the force generated in the event that the seat is forcibly returned to its down position, as might happen by an act of vandalism or accidental misuse of the device.

In the preferred construction, the bias means is a helical spring loosely mounted on a horizontal shaft on which the rear edge of the toilet seat is mounted for free swinging movement. One end of the spring is connected to the shaft and the other end of the spring cooperates with the seat such that tension in the spring applies a resilient bias force to the seat in a direction to raise the seat. The magnitude of the force is insufficient to hold the seat in a raised position, however. The shaft can be forcibly rotated by the user of the device, as with a foot-pedal and crank connection to the shaft, in a direction which winds the spring, thereby increasing tension in the spring and increasing the resilient lifting force on the seat to a magnitude sufficient to raise the seat. As the seat is now held in its raised position solely by tension in the spring, forcible manual lowering of the seat merely further winds the spring and does not overstress any of the components.

BRIEF DESCRIPTION OF THE DRAWINGS

FIGS. 1 and 2 illustrate a toilet to which a seat-lifting device 10 is connected. As is conventional the toilet includes a bowl 12, a seat 14 and a lid or cover 16.

Figure 4:
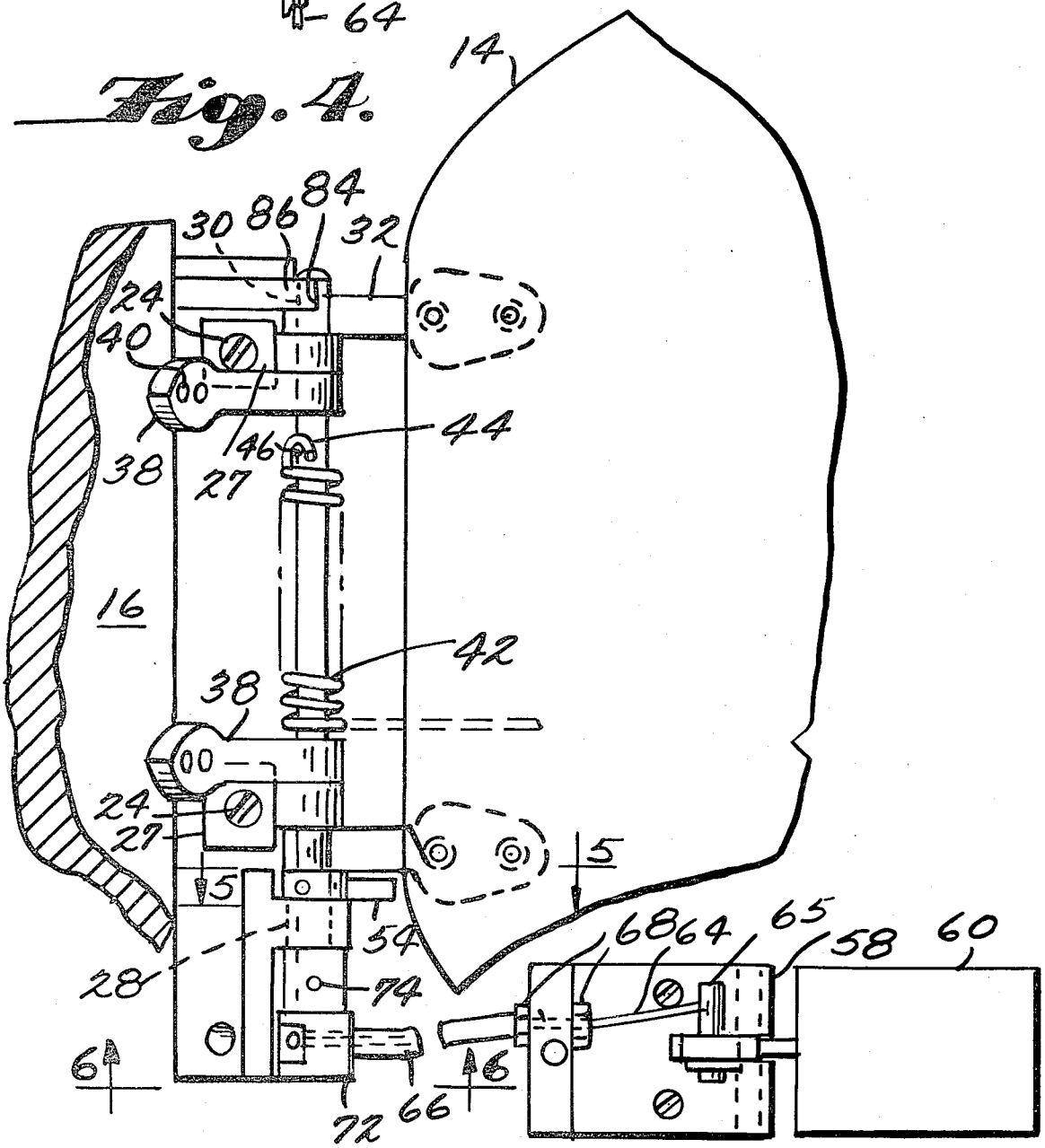
FIG. 4 is a plan view of the parts shown in FIG. 3, with the seat in its down position.

The seat-lifting device includes an elongated support assembly comprising a plate 18 and two upstanding end pieces 20,22 connected to the plate 18 at the opposite ends thereof. The plate 18 is fastened to the toilet bowl 12 by screws 24 (FIG. 4). A shaft 26 extending parallel to the plate 18 is rotatably mounted to the support assembly by means of two plastic bearing members 27 held in place by the screws 24 and having bores through which the shaft 26 extends. In addition, one end of the shaft 26 is disposed in a bore 28 in the L-shaped end piece 20 and the other end of the shaft 26 is disposed in a semi-cylindrical groove 30 in the end piece 22. The seat 14 is freely swingable about the shaft 26 by means of hinges 32 which are secured to the seat 14 by screws 34 and which have bores 36 through which the shaft 26 passes. The lid is similarly swingable about the shaft 26 by hinges 38 secured to the lid by screws 40.

Figure 5:
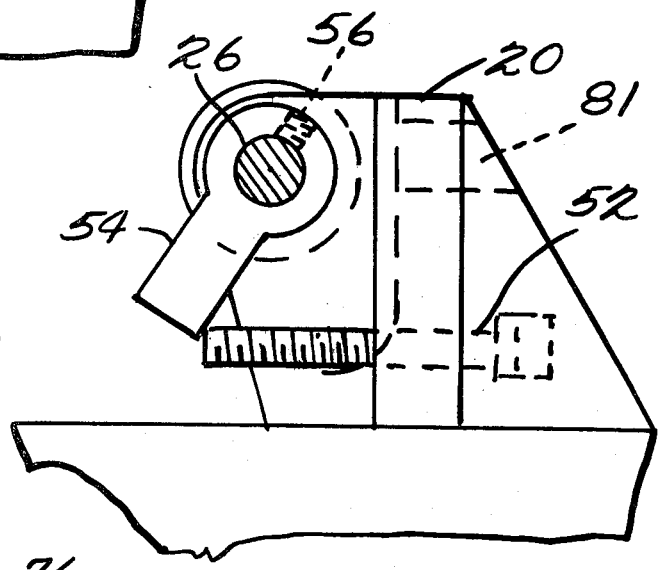
FIG. 5 is a sectional view taken on the line 5—5 of FIG. 4.

A helical tension spring 42 loosely surrounds the shaft 26. One end 44 of the spring 42 is hooked over a pin 46 carried by the shaft 26, and the other end 48 bears against the lower surface of the seat 14. A pin 50 projecting from that surface aids in maintaining the position of the spring end 48. Tension in the spring 42 applies a resilient rotational lifting force to the seat 14 via the spring end 48 and simultaneously applies a rotational resilient force in an opposite direction to the shaft. Under static conditions the torque produced by the weight of the seat exceeds or balances the lifting force on the seat 14, and the latter assumes a horizontal, down position. The proper tension to produce this result is obtained with a tension adjusting screw 52 which is threaded through the end piece 20 to engage a radial projection 54 fixed to and rotatable with shaft 26. The rotative position of the projection 54 relative to the shaft 26 can be adjusted by loosening a set screw 56, rotating the projection 54 and tightening the set screw 56. The tension adjusting screw 52 thus serves as a stop which limits rotation of the shaft 26 in the direction of downward swinging movement of the seat 14. With the seat 14 in its down position the correct spring tension is obtained by turning the screw 52 into its threaded bore in the end piece 20 to bear against the projection 54 and thereby rotate the latter and the shaft 26 clockwise as seen in FIG. 5. This winds the spring 42 into a slightly tighter helix and thereby increases the tension in the spring 42. Turning of the screw 52 is continued until the seat begins to rise and then the screw 52 is backed off sufficient to permit the seat 14 to remain horizontal.

Figure 6:
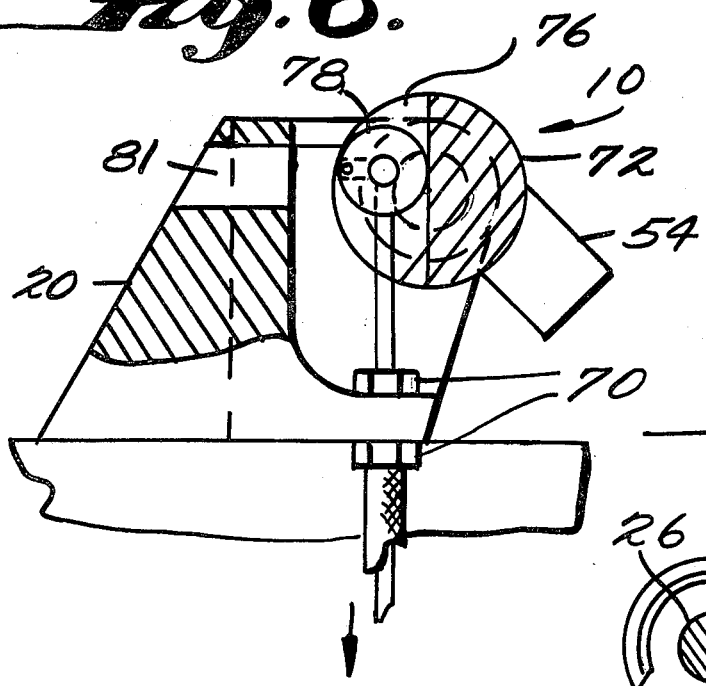
FIG. 6 is a fragmentary view, partly broken away, looking in the direction of arrows 6—6 in FIG. 4.
Figure 8:
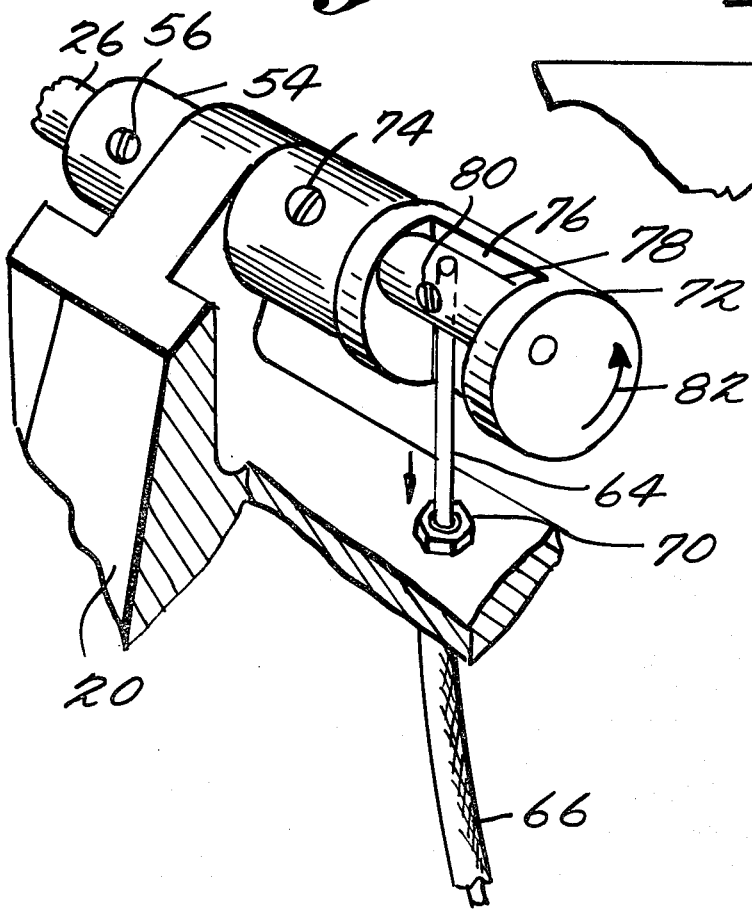
FIG. 8 is a fragmentary view illustrating the connection of the foot-operated control cable to the shaft of the lifting device.

Raising of the seat 14 is effected by further increasing the tension in the spring 42 so that the upward torque of the spring end 48 on the seat 14 exceeds the downward torque produced by the weight of the seat 14. This is effected by forcibly rotating the shaft 26 clockwise as seen in FIG. 5 by means of a user-controlled power device. While the power device may be operated electrically or by fluid pressure, it is preferred to use a mechanical device such as a foot-pedal and cable connection between the pedal and the shaft. Such an arrangement may include a floor-mounted bracket 58, a foot pedal 60 pivoted intermediate its ends to the bracket 58 as at 62 for swinging movement in a vertical plane and a cable 64 for transmitting force to the shaft 26. The cable 64, attached at one of its ends to the pedal 60 at 65, is slidable in a sheath 66 which is clamped at one end to the bracket in a conventional manner, as illustrated at 68. The other end of the sheath 66 is clamped to the end piece 20 of the support assembly in a conventional manner, as at 70. The end of the cable 64 opposite its connection to the pedal 60 is fastened to a cylindrical crank fitting 72 fixed to the shaft 26. As shown in FIG. 8 the crank fitting 72 connected to one end of the shaft 26 by a set screw 74. The fitting 72 includes a recess 76 holding within it a crank element 78 which is parallel to and offset from the axis of the shaft 26. The end of the cable 64 projects into a transverse hole in the element 78 and is secured in place by a set screw 80. Access to the set screw 80 is by way of a hole 81 in the end piece 20 as seen in FIG. 6. Downward movement of the pedal 60 creates a pull on the cable 64 and this results in rotation of the crank fitting 72 and the shaft 26 in the direction of the arrow 82 in FIG. 8 (clockwise in FIG. 5).

Figure 1:
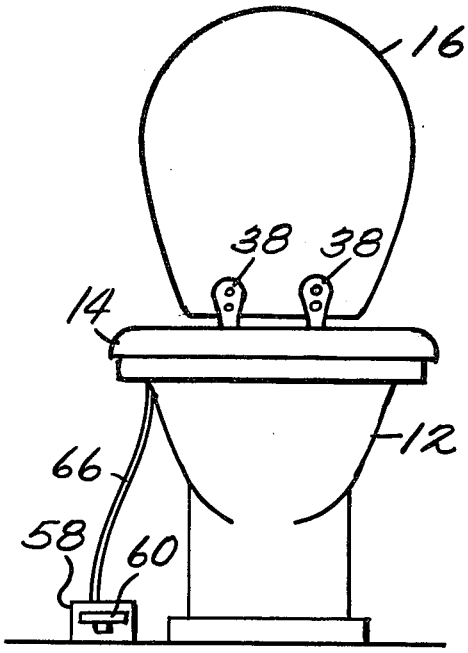
FIG. 1 is a schematic front view of a toilet which has been fitted with the seat-lifting device embodying the principles of the present invention, with the seat down.
Figure 2:
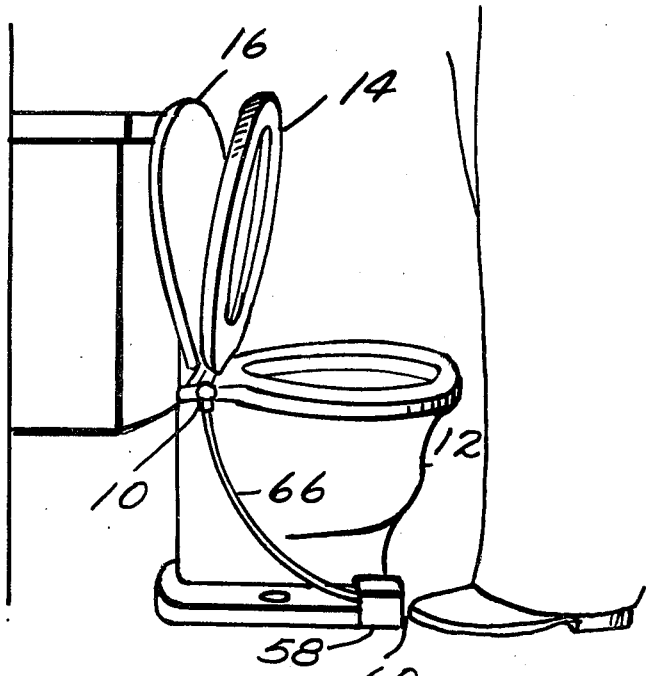
FIG. 2 is a side view of the toilet of FIG. 1, with the seat in a raised position.
Figure 3:
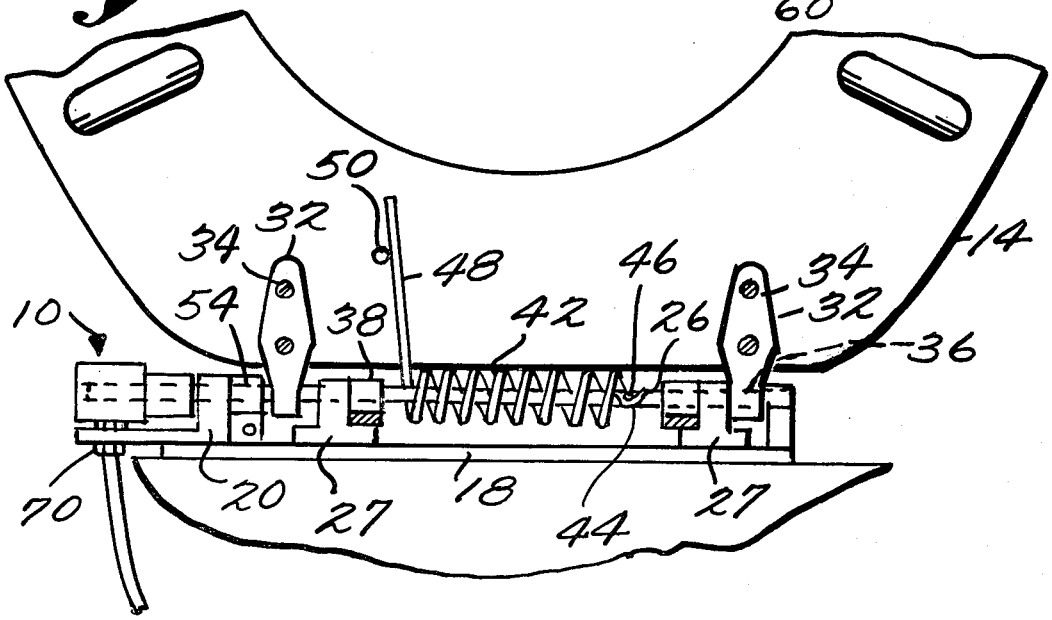
FIG. 3 is a fragmentary front view of a toilet showing the lifting device, with the seat in a raised position.
Figure 3:
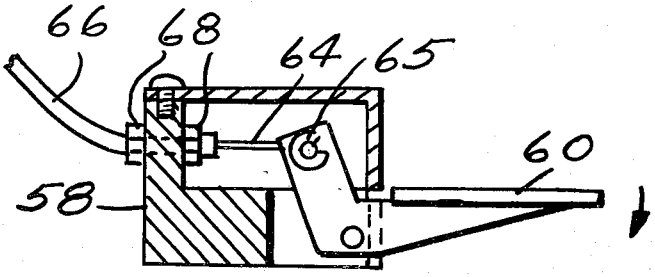
Figure 7:
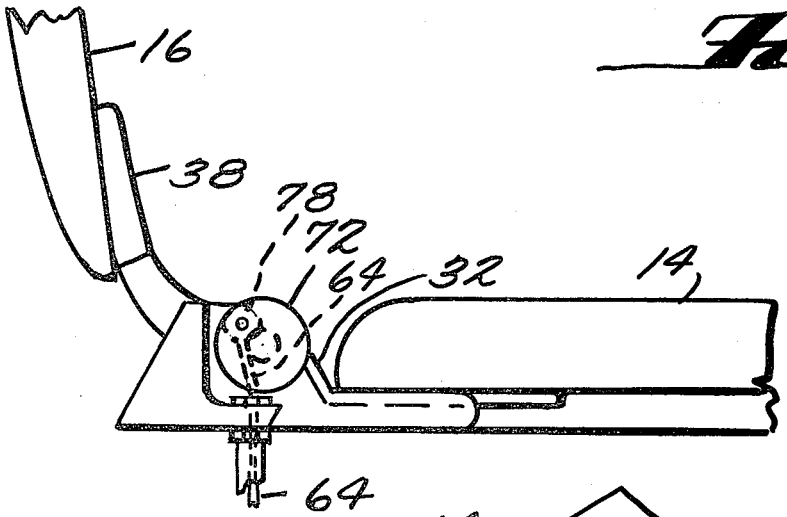
FIG. 7 is a fragmentary side view of the lifting device, with the seat down.

Operation of the lifting device is as follows. With the foot pedal 60 in its normal up position the seat 14 will be in its horizontal or down position. As described above, this function is achieved by virtue of the tension in the spring 42 being insufficient to raise the seat 14, i.e. insufficient to produce an upward torque on the seat exceeding the downward torque resulting from the weight of the seat 14. This tension, which in effect balances the weight of the seat 14, is obtained by adjusting the position of the tension-adjusting screw 52, as described above. When the foot pedal 60 is depressed the resulting pulling force of the cable 64 on the crank fitting 72 produces a torque on the fitting 72 and hence on the shaft 26 in a direction and magnitude to forcibly rotate the shaft 26 in the direction of upward swinging movement of the seat 14, i.e. clockwise in FIG. 5 and counterclockwise in FIGS. 6 and 7. This in effect winds the spring 42 thereby increasing its tension and increasing the resilient upward force applied by the spring end 48 to the seat 14. The seat 14 thereby swings upwardly to a position such as that illustrated in FIG. 2. When the foot pedal 60 is released, downward torque resulting from the weight of the seat 14 overcomes the tension in the spring 42 so that the seat 14 swings down to its horizontal position. In order for this to occur the seat 14 must not have been raised to an over-center position because in such position the weight of seat 14 would tend to continue to swing the seat 14 in a counterclockwise direction as viewed in FIG. 7. Therefore a stop is provided to prevent the seat from swinging upwardly more than about 70° from the horizontal position. In the illustrated construction the stop is provided by a shoulder 84 on the hinge 32 nearest the end piece 22, this shoulder being located so as to engage the upper surface of the end piece 22 at a location 86 adjacent the groove 30 as seen in FIG. 4, when the seat 14 reaches the 70° position.

It will be understood that modifications of the device may be made without departing from the scope of the invention. Also, the lid 16 may be coupled to the seat 14 or to the spring 42 so as to be lifted and lowered in the same manner as the seat 14.

What is claimed is:

1. A toilet seat assembly comprising a toilet seat mounted at its rear edge for free swinging movement about a horizontal axis between a horizontal position and a raised position; bias means cooperating with said seat in a manner to apply thereto in its horizontal, raised and intermediate positions an upward resilient bias force, said seat by virtue of its weight applying a downward force against said bias force in the horizontal, raised and intermediate positions of said seat, the weight of said seat being sufficient to overcome said bias force whereby said seat normally assumes a horizontal position; and operator-controlled means for selectively applying additional resilient upward bias force to said seat and for removing said additional force from said seat, said additional resilient bias force when applied being sufficient to swing said seat to its raised position, said seat thereby being held in its raised position solely by resilient upward bias forces whereby downward forces resulting from forcible manual lowering of said seat are absorbed by the bias means.

2. A toilet seat assembly as in claim 1 including a horizontal shaft on which said seat is mounted for free swinging movement relative thereto, said bias means including a helical spring loosely surrounding said shaft, said spring having one end connected to said shaft for rotation therewith and an opposite end applying said upward bias force to said seat, and said operator-controlled means including means connected to said shaft for rotating said shaft in a direction to wind said spring thereby increasing the tension in said spring.

3. A toilet seat assembly comprising: an elongated support adapted to be attached in a horizontal position to the rear edge of a toilet bowl; a rotatable shaft extending longitudinally of and supported by said support; a toilet seat mounted at its rear edge to said shaft for free rotation relative thereto; bias means cooperating with said shaft and said seat, said bias means applying a resilient rotational force to said shaft in one direction and a resilient rotational force to said toilet seat in a direction to raise said seat but insufficient to cause movement of said seat; stop means for limiting rotation of said shaft in said one direction; and operator-controlled means for applying a rotational force to said shaft in said opposite direction to thereby increase the resilient rotational force being applied by said bias means to said seat sufficiently to cause said seat to swing to a raised position and be held in said raised position by said force whereby forces generated by forcible manual lowering of said seat are absorbed by said bias means.

4. A toilet seat assembly as in claim 3 wherein said bias means is a spring.

5. A toilet seat assembly as in claim 4 wherein said spring is a helical spring loosely surrounding said shaft and having one end rotatable with said shaft and an opposite end applying said resilient rotational force to said seat, whereby rotation of said shaft in said opposite direction winds said spring and increases the tension therein.

6. A toilet seat assembly comprising a toilet seat mounted at its rear edge for free swinging movement about a horizontal axis between a down position and a raised position; tensioned spring bias means applying an upward bias force to said seat insufficient to overcome the torque resulting from the weight of said seat whereby said seat normally assumes a down position; and operator-controlled means for acting on said spring bias means to increase the tension therein sufficiently to overcome the torque of said seat to thereby raise said seat whereby said seat is held in its raised position by the resilient force of said spring bias means and whereby forcible manual lowering of said seat when biased to its raised position further increases the tension in said spring bias means.

7. A toilet seat assembly as in claim 6 including a shaft, said spring bias means including a helical spring coaxial with said shaft, said spring having one end rotatable with said shaft and an opposite end applying said upward bias force to said seat whereby a torque is applied to said shaft; means for limiting rotation of said shaft by said spring; said operator-controlled means cooperating with said shaft to rotate said shaft in a direction away from said rotation-limiting means to wind said spring thereby increasing the tension therein and increasing the resultant upward bias force on said seat.

8. A toilet seat assembly as in claim 7 wherein said seat is freely rotatable on said shaft.

9. A toilet seat assembly as in claim 7 wherein said operator-controlled means includes a foot-operated lever mounted for swinging movement about a horizontal axis and transmission means for transmitting downward swinging movement of said lever to said shaft in a manner to rotate said shaft in said spring-winding direction.

* * * * *